US005464253A

United States Patent [19]

Farrell

[11] Patent Number: 5,464,253

[45] Date of Patent: Nov. 7, 1995

[54] SQUIRT BOOK

[76] Inventor: Dennis A. Farrell, 30 Spring Rd., Chappaqua, N.Y. 10514

[21] Appl. No.: 389,962

[22] Filed: Dec. 19, 1994

[51] Int. Cl.[6] ..... B42D 1/00

[52] U.S. Cl. ..... 281/38; 281/51; 281/15.1

[58] Field of Search ..... 273/349, 457, 273/458; 446/475, 296; 281/15.1, 28, 38, 51; 402/4, 79, 80 R

[56] References Cited

U.S. PATENT DOCUMENTS

| | | | |
|---|---|---|---|
| 3,256,634 | 6/1966 | Mace | 446/475 X |
| 4,280,241 | 7/1981 | Pfaff | 281/51 X |
| 4,978,141 | 12/1990 | Wu | 281/51 X |
| 5,263,890 | 11/1993 | Dent, IV | 446/475 |
| 5,277,641 | 1/1994 | Gable et al. | 273/349 X |

*Primary Examiner*—Willmon Fridie, Jr.

[57] ABSTRACT

The squirt book has a squirt pump mounted within it, preferably in the back cover. The covers and pages of the squirt book are equipped with recesses and are sealed against water leakage. The print text and picture illustration are waterproof. The covers and pages are preferably filled with a lightweight fill so as to provide floatation, stiffness and bulk. The recesses are aligned, at least partially, so as to permit a squirt of water to pass from the back cover through any or all pages, without hindrance. The back cover encloses a pump chamber for the squirt pump, which pump has a squirt nozzle and fill valve for automatic or manual refilling. In operation, the child takes the squirt book into the tubful of bath water and reads (or pretends to read). After turning the page to the elephant, for example, the child may squeal and squeeze the book, pretending to be an elephant spraying water from its trunk. Or a whale. Or a fire hose. Or a skunk. Baths can be fun—and educational.

6 Claims, 1 Drawing Sheet

SQUIRT BOOK

BACKGROUND OF THE INVENTION

1. Field of the Invention

This invention relates to books for children, and particularly to a child's book which may be read in the bath and used as a bath toy.

2. Description of the Related Art

There are a great number of children's books, including some with mechanical devices which make the book have secondary use as a toy. There are a great number of bath toys for children.

SUMMARY OF THE INVENTION

The invention is a children's book which can provide a delightful animation in the form of a squirt of water related to the story—for example, a spouting whale story with a squirt of water.

DRAWINGS

DESCRIPTION OF A PREFERRED EMBODIMENT

Figure 1:
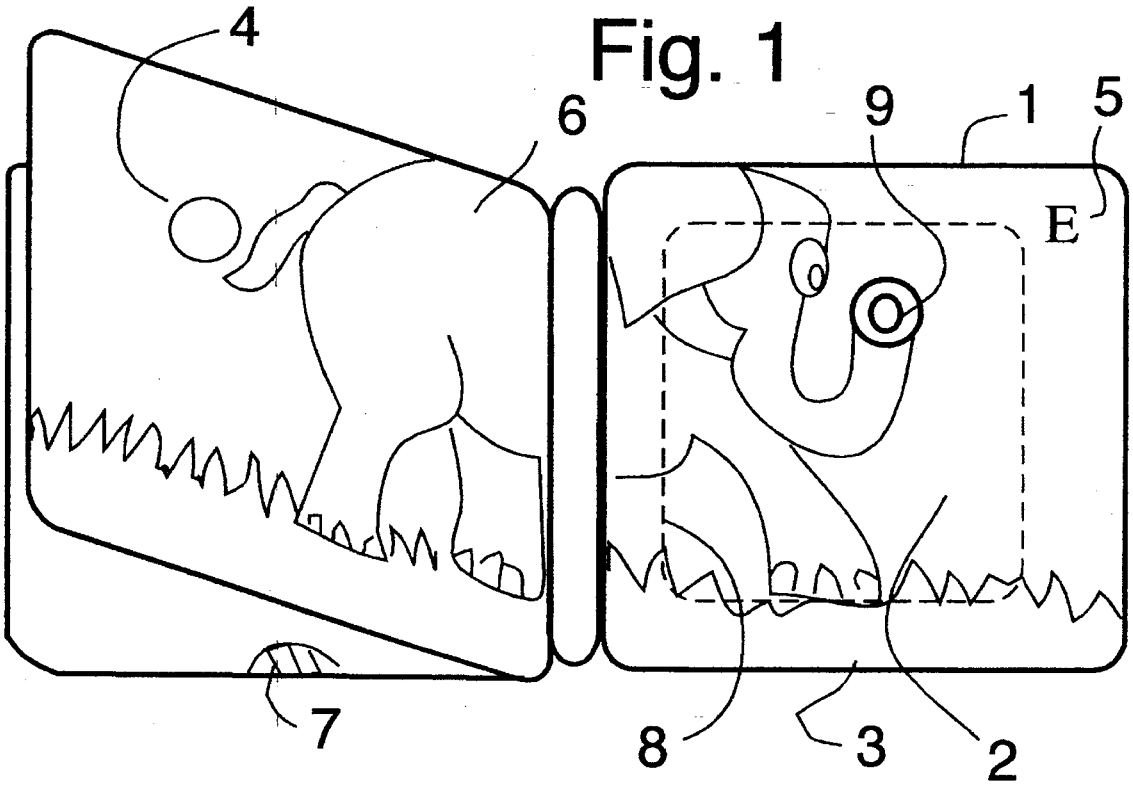
FIG. 1 shows the squirt book.

FIG. 1 shows the squirt book 1, which has a squirt pump 2 mounted within it, preferably in the back cover 3. The covers and pages of the squirt book 1 are equipped with recesses 4 and are preferably made of vinyl plastic and are sealed against water leakage, and the prim text 5 and picture illustration 6 are waterproof. The covers and pages are preferably filled with a lightweight foam fill 7 so as to provide flotation, stiffness and bulk. The recesses 4 are aligned, at least partially, so as to permit a squirt of water to pass from the back cover 3 through any or all pages, without hindrance. The squirt pump fits into pump chamber 8 so that its squirt nozzle 9 squirts perpendicularly to the page.

Figure 2:
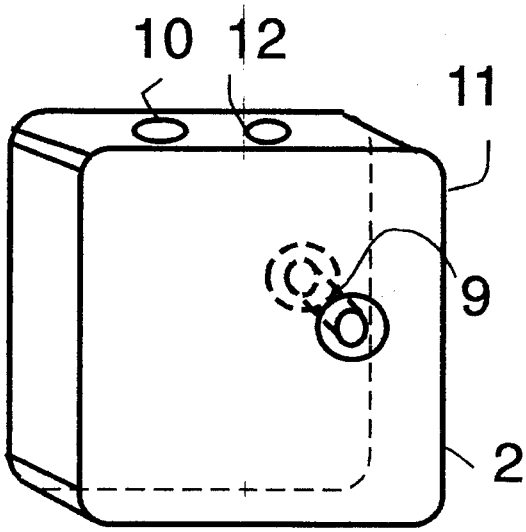
FIG. 2 shows detail of the preferred squirt mechanism.
Figure 3:
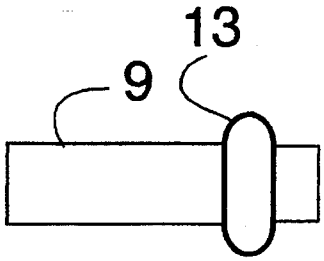
FIG. 3 is a side elevation showing detail of the preferred squirt mechanism.

FIG. 2 shows the squirt mechanism. Back cover 3 encloses a pump chamber 8 for squirt pump 2. Squirt pump 2 has a squirt nozzle 9 and fill valve 10. The pump body 11, which is preferably plastic, may be squeezed to eject water from squirt nozzle 9. When squeezing halts, and the pump fill valve or squirt nozzle is held under water, pump body 11 returns to full size as it relaxes, pulling water back in through squirt nozzle 9 or through one-way fill valve 10. The pump body 11 may also be filled through a fill cap 12. The squirt nozzle 9 is configured with an expansion end 13 which serves to lock the book together when pages are closed. The recesses 4 are configured slightly less large than the expansion end 13 so as to snap pass.

In operation, the child takes the squirt book into the tubful of bath water and reads (or pretends to read). After turning the page to the elephant, for example, the child may squeal and squeeze the book, pretending to be an elephant spraying water from its trunk. Or a whale. Or a fire hose. Or a skunk. Reading can be fun. Bathing can be fun. Reading the squirt book in the tub can be great fun, and educational.

What is claimed is:

1. A child's book (1) having text and illustration related to animals or activities involving squirts of liquid, having a number of pages which may be unopened or opened, the book comprising:

a waterproof front cover page;

a plurality of waterproof pages each having a recess (4) strategically located with respect to text (5) and illustration (6) involving a squirt activity, said recesses (4) being aligned so as to permit a squirt of water to pass through a plurality of recesses (4) in unopened pages to provide a squirt of liquid related to the squirt activity of text (5) and illustration (6) on an opened page;

a waterproof back cover page (3); and refillable pump mechanism (2) having a squirt nozzle (9) and refill means.

2. A child's book according to claim 1, wherein at least one of said pages is filled with lightweight fill.

3. A child's book according to claim 1, wherein said pump is configured to return to a finite volume and thus refill when held relaxed under the surface of a liquid.

4. A child's book according to claim 1, wherein said pump is mounted in one of said pages.

5. A child's book according to claim 1, wherein said pump is mounted in said back cover page.

6. A child's book according to claim 1, wherein said squirt nozzle has an expansion end with exterior dimensions slightly smaller than said recesses so as to serve as a lock.

* * * * *